US011236552B2

(12) United States Patent
James et al.

(10) Patent No.: US 11,236,552 B2
(45) Date of Patent: Feb. 1, 2022

(54) TUBING-ENCASED CABLE

(71) Applicant: HALLIBURTON ENERGY SERVICES, INC., Houston, TX (US)

(72) Inventors: Paul G. James, Spring, TX (US); Ibrahim El Mallawany, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 565 days.

(21) Appl. No.: 16/324,807

(22) PCT Filed: Dec. 28, 2017

(86) PCT No.: PCT/US2017/068694

§ 371 (c)(1),
(2) Date: Feb. 11, 2019

(87) PCT Pub. No.: WO2019/132916

PCT Pub. Date: Jul. 4, 2019

(65) Prior Publication Data

US 2021/0246736 A1 Aug. 12, 2021

(51) Int. Cl.

| | |
|---|---|
| ***H01B 7/02*** | (2006.01) |
| ***E21B 17/02*** | (2006.01) |
| ***H01B 7/04*** | (2006.01) |
| ***H01B 13/00*** | (2006.01) |

(52) U.S. Cl.
CPC ..... *E21B 17/028* (2013.01); *H01B 7/02* (2013.01); *H01B 7/046* (2013.01); *H01B 13/0036* (2013.01)

(58) Field of Classification Search
CPC ..... H01B 7/02; H01B 7/046; H01B 13/0036; E21B 17/028; E21B 17/043; E21B 33/10; E21B 33/13; E21B 33/122; E21B 43/12; E21B 43/14; E21B 43/128
USPC ..... 174/59, 74 R, 75 R, 78, 84 R, 88 R, 174/102 R, 108, 109, 110 R, 110 SR; 166/65.1, 75.1, 77, 313, 382, 385, 387, 166/242.6, 106, 147
See application file for complete search history.

(56) References Cited

U.S. PATENT DOCUMENTS 4,627,490 A * 12/1986 Moore ..... E21B 17/003 166/106
6,886,638 B2 * 5/2005 Ahmed ..... B23K 20/004 166/385
7,405,358 B2 * 7/2008 Emerson ..... H02G 15/18 174/88 R (Continued)

FOREIGN PATENT DOCUMENTS

EP 0235891 B1 7/1991

OTHER PUBLICATIONS

International Search Report and Written Opinion dated Sep. 7, 2018 for PCT Application No. PCT/US2017/068694 filed Dec. 28, 2017 (12 pages).

*Primary Examiner* — William H. Mayo, III
(74) *Attorney, Agent, or Firm* — Chamberlain Hrdlicka

(57) ABSTRACT

A system includes a cable with a core material, an intermediate layer surrounding the core material, a retention assembly located around the core material and configured to compress the core material and restrict the core material from moving in the cable, and an outer metallic tubular surrounding the intermediate layer. Further an electrical device is coupleable to the cable.

20 Claims, 3 Drawing Sheets

(56) References Cited

U.S. PATENT DOCUMENTS

| | | | | |
|---|---|---|---|---|
| 7,543,643 | B2 * | 6/2009 | Hill | E21B 36/04 166/302 |
| 8,783,369 | B2 * | 7/2014 | Rioufol | E21B 17/1035 166/387 |
| 8,895,856 | B2 | 11/2014 | McCullough | |
| 8,991,508 | B2 * | 3/2015 | Chavers | E21B 43/128 166/380 |
| 9,181,774 | B2 * | 11/2015 | Khisamov | E21B 43/14 |
| 9,777,561 | B2 * | 10/2017 | Hill | F04D 13/02 |
| 9,805,845 | B2 | 10/2017 | Montena | |
| 10,443,317 | B2 * | 10/2019 | O'Grady | E21B 17/003 |
| 2006/0254804 | A1 | 11/2006 | Ashibe et al. | |

* cited by examiner

TUBING-ENCASED CABLE

BACKGROUND

This section is intended to provide relevant background information to facilitate a better understanding of the various aspects of the described embodiments. Accordingly, it should be understood that these statements are to be read in this light and not as admissions of prior art.

In producing wells, it is desirable to determine if adjustments can be made to maintain or increase production. This is referred to as managing a well and such a well management system with permanently installed sensors to monitor well conditions, and controls which can be adjusted from the surface, may be referred to as an intelligent completion system. In the management of wells, particularly producing wells, it is important to obtain downhole well data to manage and control the production of hydrocarbons over the life of the well. The sensors and controls are operably connected to surface controls via a wired connection such as a tubing-encased cable. The wired connection supplies power and provides a communication path for the sensors and controls.

BRIEF DESCRIPTION OF THE DRAWINGS

Embodiments are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
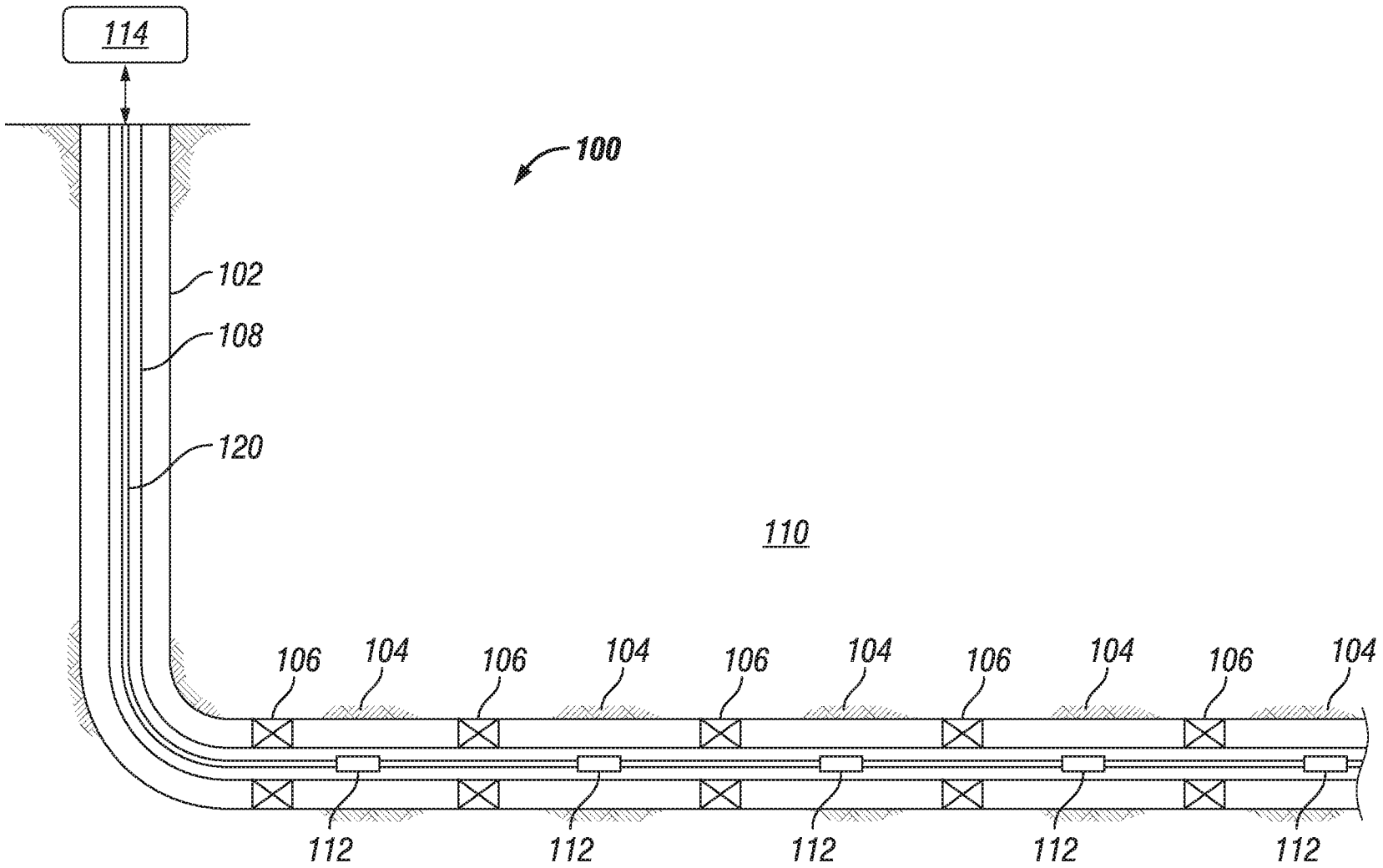
FIG. 1 depicts an elevation view of a well system, according to one or more embodiments.

FIG. 1 is an elevation view of a well system 100 employing a multi-sensor monitoring system positioned in a multi-zone wellbore according to one or more embodiments. As shown, a wellbore 102 with multiple zones 104 of interest isolated by packers 106 or other isolation devices for sealing the annulus between a production string 108 and wellbore 102 is formed in the subterranean formation 110. A monitoring system is deployed in the wellbore 102 having electrical devices 112 operably connected to a tubing-encased cable 120. The electrical devices 112 may be downhole permanent gauges, such as pressure or temperature gauges installed along the production string 108. The electrical devices 112 may also be any suitable electrical device deployed downhole, including but not limited to a flow control system, a sensor, or sensor network.

The tubing-encased cable 120 may be positioned inside the production string 108 or in the annular space outside the production string 108. The tubing-encased cable 120 may also be positioned outside casing (not shown) positioned in the annular space between the outside casing (not shown) and the formation 110 in the wellbore 102.

Figure 4:
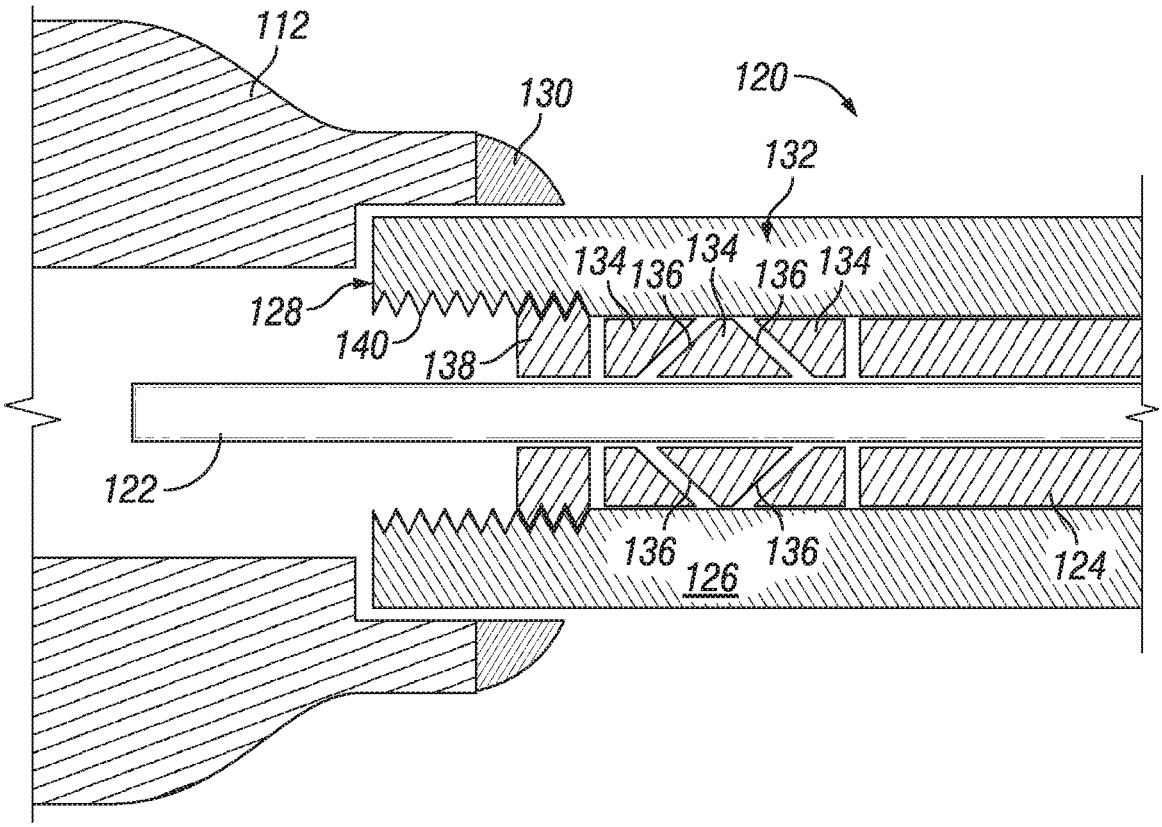
FIG. 4 depicts a cross sectional view of the tubing-encased cable welded to an electrical device, according to one or more embodiments.

The electrical devices 112 (e.g., pressure and temperature sensors) may be directly welded to the tubing-encased cable 120 as further described herein with respect to FIG. 4. This allows the electrical devices 112 and the tubing-encased cable 120 to be welded before being delivered to the well, which in turn avoids the time consuming process of connecting the electrical devices 112 and the cable 120 at the well site. Welding also provides a high reliability, pressure tight permanent connection between the cable 120 and the electrical device 112.

Within the zones of interest, the electrical devices 112 are positioned to measure environmental parameters, such as pressure, temperature, or flow rate of fluids in the wellbore 102 or annulus. The measured data is transmitted uphole, preferably by the tubing-encased cable 120, to a surface system 114. The tubing-encased cable 120 is also used to carry electrical power downhole from the surface to power the electrical devices 112 positioned in the wellbore.

The surface system 114 sends and receives signals from the downhole sensors and devices via a surface transceiver (not shown). The surface system 114 may present to an operator desired production parameters and other information via one or more output devices (not shown), such as a display, a computer monitor, speakers, lights, etc., which may be used by the operator to control the well production operations. The surface system 114 also includes a processor and memory (not shown), which are operable to process the received signals according to programmed instructions. The surface system 114 may process data according to programmed instructions, such as data models, and respond to user commands entered through a suitable input device (not shown) in the nature of a keyboard, touchscreen, microphone, mouse, joystick, image sensor, or other user input devices. Additionally, the surface system 114 includes a controller operable to send command signals to the electrical devices 112 in the wellbore 102.

Figure 2:
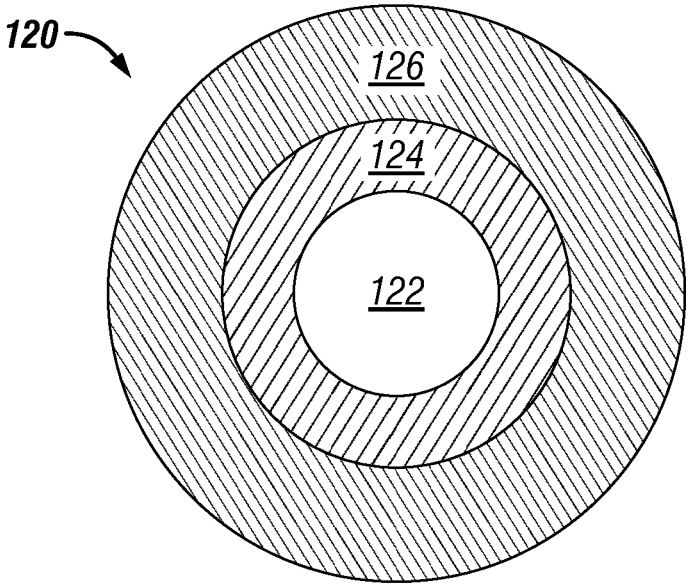
FIG. 2 depicts a cross sectional view of a tubing-encased cable, according to one or more embodiments.

FIG. 2 is a cross-sectional view of the tubing-encased cable 120 employed to power and provide a communication path for electrical devices, in accordance with one or more embodiments. As shown, the cable 120 comprises, at a minimum, a core material 122, an intermediate layer 124, and an outer metallic tubular 126. The core material 122 provides an electrical path to supply power to the electrical devices 112 of FIG. 1 and a communication path for the surface system 114 of FIG. 1 to send or receive data. The core material 122 may be a conductive material such as copper or a copper alloy. The core material 122 may also be a stranded wire or a solid wire that runs the length of the tubing-encased cable 120. The core material 122 may also be formed of multiple concentric layers as further described herein with respect to FIG. 3. One or more conductors can also be used in the core to provide shielding or change the impedance of the cable.

The intermediate layer 124 surrounds the core material 122 to electrically separate the conductive path of the core material 122 from the outer metallic tubular 126. The intermediate layer 124 may include an insulating polymer comprising Fluorinated ethylene propylene (FEP). The intermediate layer 124 may be formed by extruding an insulative layer 124 around the core material 122. The electrically insulating layer 124 may also be formed from multiple concentric layers of electrically insulating materials.

The outer metallic tubular 126 provides a pressure sealed exterior armor for the tubing-encased cable 120. The outer metallic tubular 126 may include a corrosion and abrasion resistant metal alloy including a nickel alloy or a steel alloy.

The outer metallic tubular 126 may be formed by compressing a sheet or an open tubular of metallic material around the intermediate layer 124 and welding the edges of the metallic material along the longitudinal axis of the cable 120. The outer metallic tubular 126 is compressed to engage the intermediate layer 124 and the welded joint provides a permanent pressure seal along the cable 120. The outer metallic tubular 126 also facilitates welding the cable 120 to the electrical device 112 of FIG. 1 to provide a reliable permanent pressure seal between those components. The outer metallic tubular 126 may be bare or surrounded by a polymer protective sheath (not shown).

Figure 3:
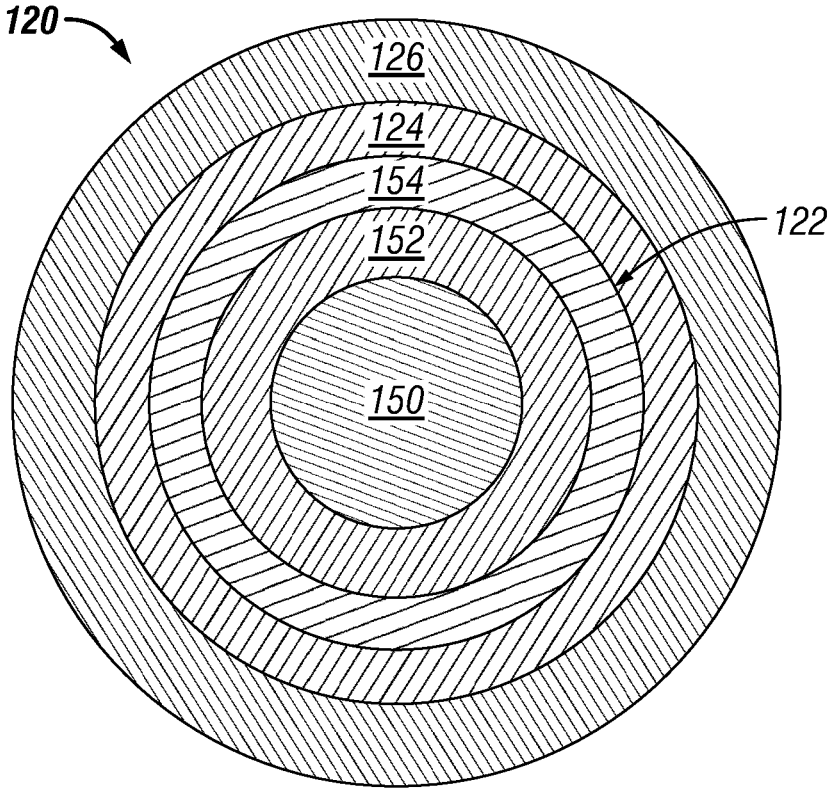
FIG. 3 depicts cross sectional view of another tubing-encased cable, according to one or more embodiments.

The tubing-encased cable 120 may also include other layers of conductive and insulating materials. For instance, FIG. 3 depicts a cross-sectional view of the tubing-encased cable 120 that includes additional layers of material in the core material 122. As previously mentioned, the core material 122 may include multiple concentric layers. As shown in FIG. 3, the core material 122 includes a conductive core 150, an insulating layer 152, and electrical shielding 154. The conductive core 150 may be an electrically conductive material including copper or a copper alloy.

The insulating layer 152 surrounds the conductive core 150 to electrically separate the conductive core 150 from the electrical shielding 154. The insulating layer 152 may be an electrically insulating material such as FEP.

The electrical shielding 154 surrounds the insulating layer 152 to electrically isolate the conductive core 150 from any outside electrical interference. The electrical shielding 154 may include a conductive or magnetic material including but not limited to copper or nickel.

As previously discussed, the tubing-encased cable 120 may be welded to electrical device to provide a permanent pressure seal. For example, FIG. 4 depicts a cross-sectional view of the tubing-encased cable 120 welded to an electrical device 112, according to one or more embodiments. As shown, a distal end 128 of the cable 120 is welded to the electrical device 112 at the weld seam 130. Although only one distal end 128 is depicted in FIG. 3, the cable 120 may be similarly welded and constructed on the other distal end (not shown) of the cable 120 as further described herein.

As shown, the core material 122 extends into the electrical device 112 to electrically couple with the electrical device 112. The core material 122 may be soldered to an electrical circuit housed in the electrical device 112.

One issue with welding the electrical device 112 directly to the cable 120 is that the welded area on the cable 120 increases in temperature during the welding process such that the intermediate layer 124 or other insulating layers (e.g., the insulating layer 154 of FIG. 3) may burn or be damaged if that layer is not suitably spaced from the weld seam 130. As such, the intermediate layer 124 of FIG. 3 is spaced from the weld seam 130 to prevent any damage to the intermediate layer 124 during the welding process.

Another issue with the tubing-encased cable 120 is that as the cable 120 is deployed in or retrieved from the wellbore, or while operating in the wellbore, the cable 120 is subjected to a wide range of pressures and temperatures. As the conductive materials of the core material 122 may have a higher coefficient of thermal expansion than the other materials of the cable 120, conductive layers or the core material 122 itself may expand faster than the other materials due to pressure or temperature effects encountered. As the core material 122 expands, it tends to move out of the distal end 128 of the cable 120. The expansion of the core material 122 may cause the core material 122 to short circuit on the outer metallic tubular 126 or any other conductive surface.

The core material 122 may also contract due to pressure or temperature effects encountered. As the core material 122 contracts, the distal end of the core material 122 tends to move into the cable. The contraction of the core material 122 may cause the core material 122 to decouple from its electrical connection within the electrical device 112 causing an open circuit.

To prevent this movement of the core material 122, the cable 120 includes a retention assembly 132 that applies a radial compressive force to the core material 122 to hold the core material 122 in place. The retention assembly 122 includes compression sleeves 134 having one or more beveled edges 136 that force the middle compression sleeve 134 to compress radially inward onto the core material 122. This radial compressive force applied to the core material 122 will restrict the movement of the core material 122 in the cable 120.

The compression sleeves 134 may be beveled compression rings or ferrules comprising an electrically insulating material, such as FEP or polyetheretherketone (PEEK). The outer compression sleeve 134 engages a retention collar 138 that applies an axial compressive force towards the intermediate layer 124. The inner compression sleeve 134 is positioned in the cable 120 to engage the intermediate layer 124 and the middle compression sleeve 134. However, the outer compression sleeve 134 may be integral with the retention collar 138, and the inner compression sleeve 134 may be integral with the intermediate layer 124, and the central compression sleeve 134 may be integral with either of the inner or outer compression sleeves 134.

The retention collar 138 is positioned in the interior of the cable 120 to apply an axial force to the retention assembly 132. The retention collar 138 is coupled to a retention surface 140 of the interior of the outer metallic tubular 126 at the distal end 128 of the cable 120. The retention collar 138 is annular in shape to receive the core material 122 through it and is made of or coated with an electrically insulating material, such as FEP or PEEK. The retention collar 138 and retention surface 140 may be threaded to fasten the retention collar 138 to the interior of the cable 120. As another mechanism for coupling the retention collar 138, the retention surface 140 may be a ratcheted surface that receives one or more pawls on the retention collar 138 to prevent the retention collar 138 moving towards the distal end 128 of the cable 120. The retention surface 140 may be formed prior to installation of the retention collar 138 in the cable 120 or as part of the installation process for the retention collar 138.

Before welding the electrical device 112 to the cable 120, the retention assembly 132 is positioned in the outer metallic tubular 126 to engage the intermediate layer 124. The retention collar 138 is fastened inside the outer metallic tubular 126 to apply an axial compressive force to the retention assembly 132 in the direction of the intermediate layer 124. This axial compressive force in turn compresses the middle compression sleeve 134 radially inward towards the core material 122. This radial compressive force provides resistance to the core material 120 from expanding out from or contracting into the cable 120. The retention collar 138 and the retention assembly 132 also displaces the intermediate layer 124 from the weld seam 130 to prevent any damage to the intermediate layer 124 that may be caused during the welding process.

The tubing-encased cable disclosed herein enables the cable to be welded directly to an electrical device by spacing the intermediate layer from the weld seam to prevent the intermediate layer from being burned or damaged during the welding process. The tubing-encased cable also includes a retention assembly that restricts the movement of the core material while being subjected to various temperatures and pressures over the course of the cable's lifetime. By restricting the movement of the core material, the retention assembly also serves to prevent the core material from shorting or opening the electrical circuit between the cable and electrical device.

In addition to the embodiments described above, many examples of specific combinations are within the scope of the disclosure, some of which are detailed below:

Example 1: A system, comprising: a cable comprising: a core material, an intermediate layer surrounding the core material, a retention assembly located around the core material and configured to compress the core material and restrict the core material from moving in the cable, and an outer metallic tubular surrounding the intermediate layer; and an electrical device coupleable to the cable.

Example 2: The system of example 1, wherein the retention assembly comprises compression sleeves.

Example 3: The system of example 2, wherein one of the compression sleeves comprises at least one beveled edge.

Example 4: The system of example 2, wherein the compression sleeves are engaged with each other.

Example 5: The system of example 2, wherein the cable further comprises a retention collar fastened to a distal end of the cable and engaged with the retention assembly to compress the retention assembly against the intermediate layer.

Example 6: The system of example 5, wherein one of the compression sleeves is engageable with the intermediate layer, and another one of the compression sleeves is engageable with the retention collar.

Example 7: The system of example 1, wherein the electrical device is welded to the outer metallic tubular.

Example 8: The system of example 1, wherein the outer metallic tubular and the electrical device are sealed at atmospheric pressure.

Example 9: The system of example 1, wherein the electrical device is a sensing device.

Example 10: The system of example 1, wherein the cable is locatable in a wellbore intersecting a subterranean formation.

Example 11: A method of restricting a core material from moving inside a cable, comprising: positioning a retention assembly in an outer metallic tubular of the cable; and coupling a retention collar to a distal end of the outer metallic tubular such that the retention collar engages the retention assembly, which applies a compressive force to the core material and restricts the core material from moving inside the cable.

Example 12: The method of example 11, wherein positioning the retention assembly comprises engaging compressive sleeves with each other in the outer metallic tubular to apply the compressive force to the core material.

Example 13: The method of example 11, wherein positioning the retention assembly comprises engaging a compression sleeve to an intermediate layer that surrounds the core material to apply the compressive force to the core.

Example 14: The method of example 11, wherein coupling a retention collar comprises engaging the retention collar to a compression sleeve to apply the compressive force to the core material.

Example 15: The method of example 11, further comprising coupling an electrical device to the outer metallic tubular.

Example 16: The method of example 15, wherein coupling the electrical device comprises welding the electrical device to the outer metallic tubular.

Example 17: The method of example 15, wherein coupling the electrical device to the outer metallic tubular comprises sealing the electrical device and the outer metallic tubular at atmospheric pressure.

Example 18: A cable, comprising: a core material; an intermediate layer surrounding the core material; a retention assembly located around the core material and configured to compress the core material and restrict the core material from moving in the cable; and an outer metallic tubular surrounding the intermediate layer.

Example 19: The cable of example 18, wherein the retention assembly comprises compression sleeves.

Example 20: The cable of example 19, further comprising a retention collar fastened to a distal end of the cable and engaged with the retention assembly to compress the retention assembly against the intermediate layer.

This discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present disclosure has been described with respect to specific details, it is not intended that such details should be regarded as limitations on the scope of the disclosure, except to the extent that they are included in the accompanying claims.

What is claimed is:

1. A system, comprising:

a cable comprising:

a core material, an intermediate layer surrounding the core material, an outer metallic tubular surrounding the intermediate layer, a retention assembly located within the outer metallic tubular and around the core material and configured to compress the core material and restrict the core material from moving in the cable; and an electrical device coupleable to the cable.

2. The system of claim 1, wherein the retention assembly comprises compression sleeves.

3. The system of claim 2, wherein one of the compression sleeves comprises at least one beveled edge.

4. The system of claim 2, wherein the compression sleeves are engaged with each other.

5. The system of claim 2, wherein the cable further comprises a retention collar fastened to a distal end of the cable and engaged with the retention assembly to compress the retention assembly against the intermediate layer.

6. The system of claim 5, wherein one of the compression sleeves is engageable with the intermediate layer, and another one of the compression sleeves is engageable with the retention collar.

7. The system of claim 1, wherein the electrical device is welded to the outer metallic tubular.

8. The system of claim 1, wherein the outer metallic tubular and the electrical device are sealed at atmospheric pressure.

9. The system of claim 1, wherein the electrical device is a sensing device.

10. The system of claim 1, wherein the cable is locatable in a wellbore intersecting a subterranean formation.

11. A method of restricting a core material from moving inside a cable, comprising:

positioning a retention assembly in an outer metallic tubular of the cable; and coupling a retention collar to a distal end of the outer metallic tubular such that the retention collar engages the retention assembly, which applies a compressive force to the core material and restricts the core material from moving inside the cable.

12. The method of claim 11, wherein positioning the retention assembly comprises engaging compressive sleeves with each other in the outer metallic tubular to apply the compressive force to the core material.

13. The method of claim 11, wherein positioning the retention assembly comprises engaging a compression sleeve to an intermediate layer that surrounds the core material to apply the compressive force to the core.

14. The method of claim 11, wherein coupling a retention collar comprises engaging the retention collar to a compression sleeve to apply the compressive force to the core material.

15. The method of claim 11, further comprising coupling an electrical device to the outer metallic tubular.

16. The method of claim 15, wherein coupling the electrical device comprises welding the electrical device to the outer metallic tubular.

17. The method of claim 15, wherein coupling the electrical device to the outer metallic tubular comprises sealing the electrical device and the outer metallic tubular at atmospheric pressure.

18. A cable, comprising:

a core material;

an intermediate layer surrounding the core material;

an outer metallic tubular surrounding the intermediate layer; and a retention assembly located within the outer metallic tubular and around the core material and configured to compress the core material and restrict the core material from moving in the cable.

19. The cable of claim 18, wherein the retention assembly comprises compression sleeves.

20. The cable of claim 19, further comprising a retention collar fastened to a distal end of the cable and engaged with the retention assembly to compress the retention assembly against the intermediate layer.

* * * * *